US006715499B2

(12) United States Patent
Bartels et al.

(10) Patent No.: US 6,715,499 B2
(45) Date of Patent: Apr. 6, 2004

(54) WATER LANCE BLOWER WITH MONITORING DEVICE FOR QUALITY OF A WATER JET AND METHOD OF OPERATING THE SAME

(75) Inventors: Franz Bartels, Hamminkeln (DE); Manfred Frach, Wesel (DE); Klaus Eimer, Ratingen (DE)

(73) Assignee: Clyde Bergmann GmbH, Wesel (DE)

( * ) Notice: Subject to any disclaimer, the term of this patent is extended or adjusted under 35 U.S.C. 154(b) by 0 days.

(21) Appl. No.: 10/237,229

(22) Filed: Sep. 3, 2002

(65) Prior Publication Data

US 2003/0047196 A1 Mar. 13, 2003

Related U.S. Application Data

(63) Continuation of application No. PCT/EP01/02288, filed on Mar. 1, 2001.

(30) Foreign Application Priority Data

Mar. 1, 2000 (DE) ..... 100 09 831

(51) Int. Cl.[7] ..... B08B 3/02; B08B 9/04

(52) U.S. Cl. ..... 134/22.12; 134/22.18; 134/24; 134/113; 134/167 R; 134/178

(58) Field of Search ..... 134/113, 166 R, 134/167 R, 168 R, 169 R, 172, 198, 19, 22.12, 22.18, 24; 122/382, 383, 390, 405

(56) References Cited

U.S. PATENT DOCUMENTS

| | | | | |
|---|---|---|---|---|
| 4,718,376 A | * | 1/1988 | Leroueil et al. | 122/390 |
| 5,181,482 A | | 1/1993 | Labbe et al. | 122/392 |
| 5,564,371 A | | 10/1996 | Ashton et al. | 122/392 |
| 5,619,771 A | * | 4/1997 | Minic | 15/316.1 |
| 5,925,193 A | | 7/1999 | Bude et al. | 134/18 |
| 6,035,811 A | | 3/2000 | Bude et al. | 122/390 |
| 6,073,641 A | | 6/2000 | Bude et al. | 134/172 |
| 6,101,985 A | | 8/2000 | Bude et al. | 129/379 |
| 6,283,069 B1 | | 9/2001 | Bude et al. | 129/379 |

FOREIGN PATENT DOCUMENTS

| | | |
|---|---|---|
| DE | 195 02 096 A1 | 7/1996 |
| DE | 196 05 287 A1 | 8/1997 |
| DE | 196 47 868 C1 | 2/1998 |
| DE | 196 40 337 A1 | 3/1998 |
| WO | WO 96/38701 | 12/1996 |
| WO | WO 96/38702 | 12/1996 |
| WO | WO 96/38703 | 12/1996 |
| WO | WO 96/38704 | 12/1996 |

* cited by examiner

*Primary Examiner*—Randy Gulakowski
*Assistant Examiner*—Joseph L Perrin
(74) *Attorney, Agent, or Firm*—Laurence A. Greenberg; Werner H. Stemer; Gregory L. Mayback

(57) ABSTRACT

A water lance blower for cleaning heat installations includes a water lance moveably mounted with a mouth thereof at or in a hatch. The water lance can blow a jet of water through the heating installation, through which flames and/or flue gases are guided, to wall regions accessible from the hatch, during operation. The water lance is provided with at least one sensor for detecting at least one predeterminable measurement value for monitoring the quality of the water jet. A method for operating the water lance blower includes detecting and evaluating at least one parameter characteristic of the quality of the water jet as a measurement value during operation of the water lance blower. The method permits an evaluation of the cleaning effect of the water lance blower during operation and, if required, influencing of the same.

29 Claims, 2 Drawing Sheets

WATER LANCE BLOWER WITH MONITORING DEVICE FOR QUALITY OF A WATER JET AND METHOD OF OPERATING THE SAME

CROSS-REFERENCE TO RELATED APPLICATION

This application is a continuation of copending International Application No. PCT/EP01/02288, filed Mar. 1, 2001, which designated the United States and was not published in English.

BACKGROUND OF THE INVENTION

Field of the Invention

The invention relates to a water lance blower or blaster for the cleaning of thermal installations, including a water lance having a nozzle for forming a water jet and having a mouth. The water lance is movably disposed with its mouth at or in a hatch and is capable of blowing the water jet through a thermal installation, which is in operation and has flames and/or smoke gases flowing therein, onto wall regions capable of being reached from the hatch. The invention also relates to a method for operating a water lance blower for the cleaning of a thermal installation, which includes providing a water lance having a mouth and having a nozzle for forming a water jet. The water lance is movably disposed with its mouth at or in a hatch and is capable of blowing a water jet through the thermal installation, which is in operation and in which flames and/or smoke gases flow, onto wall regions capable of being reached from the hatch.

Water lance blowers of that type and methods for operating them are described, for example, in International Publication Nos. WO 96/38701 and WO 96/38703, corresponding to U.S. Pat. Nos. 5,925,193; 6,035,811; and 6,283,069, International Publication No. WO 96/38702 corresponding to U.S. Pat. No. 6,073,641 and International Publication No. WO 96/38704 corresponding to U.S. Pat. No. 6,101,985. Water lance blowers of that kind discharge a bunched water jet through a combustion space onto an opposite wall and thus clean the thermal installations during operation, in particular the combustion spaces of steam boilers. A flaking-off of dirt formed of soot, slag and ash is brought about as a result of kinetic water jet energy and of violent evaporation of water which has penetrated into pores of deposits.

A region of impingement of the water jet of a water lance blower generally follows a defined predeterminable path on a surface to be cleaned, which is also known as a blow figure. That path generally runs in a meander-like manner and, where appropriate, avoids obstacles, orifices or other sensitive zones.

In order to ensure an effective cleaning of the thermal installations, it is necessary for a jet emerging from a water lance to maintain a predeterminable quality during the operation of the water lance blower. The water lance has a nozzle which is disposed on the thermal installation in such a way that the nozzle is exposed permanently to flames and/or smoke gases, flue gases or fumes within the thermal installation. The result thereof is that the nozzle becomes dirty and various particles, such as, for example, soot, ash or the like, settle on or in the nozzle. In addition, residues from the water, such as, for example, lime, also settle inside the nozzle.

Those deposits may, for example, narrow the nozzle orifice from which the water jet emerges and therefore adversely influence the water jet quality. Possible consequences are, for example, the widening or bursting-open of the water jet after the latter has left the nozzle. There is consequently the possibility that, because of a dirty nozzle, the water jet will not exactly follow a predetermined blow figure and therefore put sensitive zones of the thermal installations at risk. Furthermore, deposits within the nozzle increase friction between the water stream and the nozzle wall and consequently reduce the water quantity per unit time which is conducted through the nozzle. Moreover, due to the increased roughness of the nozzle wall, the deposits may cause the water jet to burst open directly when it leaves the nozzle, with opposite wall regions of the thermal installation no longer being reached or only being partially reached. The cleaning action of the water jet is thus reduced.

At the present time, the water jet quality of the known water lance blowers is determined, for example, through the use of operating properties of pumps generating a water stream, a visual check and evaluation of the nozzle or a subsequent assessment of the cleaning action. The water pumps are mostly disposed far away from the water lance and moreover often supply a plurality of water lances. It is therefore only possible with difficulty to assess an individual water jet and identify the cause of a reduction in the water jet quality. A visual check and evaluation of the nozzle is very complicated and requires highly qualified assistants who can infer the degree of soiling of the nozzle on the basis of external observation. In the subsequent assessment of cleaned surfaces of the thermal installation, residual dirt on the boiler wall and deviation of the impinging water jet from the predetermined blow figure are of main concern. Due to the thermal installation being operated in parallel, an appraisal of the cleaning action is only possible at a very high outlay in terms of sensors in or on the boiler wall. Moreover, the cleaning action achieved only ensures an inaccurate forecast of the water jet quality during the following cleaning process.

SUMMARY OF THE INVENTION

It is accordingly an object of the invention to provide a water lance blower with a monitoring device for the quality of a water jet and a method for operating the same, which overcome the hereinafore-mentioned disadvantages of the heretofore-known devices and methods of this general type and which permit the quality and therefore also the cleaning action of the generated water jet to be assessed reliably, even during operation.

With the foregoing and other objects in view there is provided, in accordance with the invention, a water lance blower for cleaning a thermal installation having flames and/or smoke gases flowing therein during operation. The thermal installation has a hatch and wall regions accessible from the hatch. The water lance blower comprises a water lance having a mouth and having a nozzle for forming a water jet. The water lance is movably disposed with the mouth at or in the hatch for blowing the water jet through the thermal installation and onto the wall regions during operation of the thermal installation. The water lance has at least one sensor for detecting at least one characteristic parameter, as a measurement value, for monitoring quality of the water jet.

Therefore, the water lance blower according to the invention is distinguished in that the water lance has at least one sensor which is disposed in such a way that the latter detects at least one parameter for monitoring the quality of the water jet. The configuration of the at least one sensor on or in the water lance takes place according to the type of sensor and the parameter to be measured. The sensor may be disposed inside or outside the thermal installation. The measurement values detected by the at least one sensor are transmitted and subsequently evaluated. An objective assessment of the jet quality of a water lance during operation is possible for the first time through the use of such sensor technology.

In accordance with another feature of the invention, the at least one sensor is constructed as a solid-borne sound sensor. The solid-borne sound sensor is mounted, preferably outside the thermal installation, on the water lance. The solid-borne sound sensor is constructed, in particular, as a microphone or a piezoelectric acceleration recorder. It is particularly advantageous to mount a plurality of solid-borne sound sensors which, for example, record the solid-borne sound of different frequency ranges. This subsequently ensures a more accurate frequency analysis of the measurement values or makes it possible to carry out a separate analysis of various parts of the water lance.

In accordance with a further feature of the invention, the nozzle of the water lance is disposed inside the thermal installation and the nozzle has at least one capacitively acting sensor, through the use of which the water content in the surroundings of the nozzle which are near the water jet can be determined. The capacitively acting sensor is preferably disposed on the surface and/or in depressions of the nozzle. The simple provision of sensors of this type is particularly suitable for the detection of measurement values at this point of the water lance.

In accordance with an added feature of the invention, at least one temperature sensor is disposed on the surface and/or in depressions of the nozzle. The depressions are introduced particularly simply and inexpensively into the material of the nozzle as bores. The temperature sensors which are used are preferably thermocouples or resistance sensors. Thermocouples are particularly suitable because of their robustness and reliability. In this case, the thermocouples are thermally conductively fastened to the nozzle, in particular through the use of a pulsed-current welding method. Resistance sensors can be produced very simply and cost-effectively and are therefore an inexpensive and suitable alternative.

In accordance with an additional feature of the invention, measures are provided which detect the water temperature upon entry into the water lance. A measurement profile of the temperature at the nozzle is substantially dependent on the temperature of the water flowing through. For this reason, the water temperature is additionally detected, in which case the measurement point may be on the water lance. In particular, however, it is advantageous to use a measurement point which is not disposed on moved parts of the water lance blower or on a water delivery line, thus making it possible to transmit the measurement values in a simple way.

In accordance with yet another feature of the invention, the water lance blower is provided with an evaluation unit for the further processing of the detected measurement value. The transmission of the measurement values from the sensor to the evaluation unit is preferably carried out through the use of an appropriately protected electrical conductor. Influence exerted on the measurement values by external disturbance variables may be prevented particularly effectively through the use of glass-fiber-insulated connecting lines which are additionally surrounded by a protective metal tube against impurities and water. These connecting lines are either led along the water lance and further on through the drive system of the water lance blower or guided from the water lance directly to the evaluation unit. Measures are preferably provided which ensure the functionality of the connecting line even in the event of a movement of the water lance. The further processing of the detected measurement value may therefore also be carried out at locations which are further away from the water lance blower. The evaluation of the measurement values is either analog or digital. If a digital evaluation of the measurement values takes place, an analog/digital converter must be provided.

In accordance with yet a further feature of the invention, the sensor is fastened, for example, to the nozzle of the water lance and mounted in such a way that it is possible to exchange a dirty nozzle with or without the sensor. In this case, either the sensor can be removed from the dirty nozzle in such a way that the functionality of the sensor is maintained and it can be fastened to the new nozzle again or the sensor or its connecting line has an interface allowing a joint exchange of the nozzle together with the sensor. In addition, the water lance blower is provided with measures which make it possible to calibrate the sensor after the exchange of the nozzle and/or of the sensor. Calibration serves for recording a reference value or a reference profile of the measurement value, with a new and clean nozzle as a reference quantity for the further evaluation of the nozzle soiling.

In accordance with yet an added feature of the invention, the water lance blower has an information unit which is preferably constructed with optically and/or acoustically reacting devices. Information which is important for the water jet quality or the degree of soiling of the nozzle can thus be made available to an operator of the water lance blower. In particular, the optically reacting devices have an indicator provided with different colors. The color of the indicator in this case is advantageously chosen with signal colors according to the water quality. The acoustically reacting devices are preferably constructed as loudspeakers or signaling horns, in which case they can emit a warning sound if the water jet quality is no longer sufficient.

In accordance with yet an additional feature of the invention, the water lance blower has a regulating unit, through the use of which the operating behavior of the water lance blower can be influenced. The regulating unit in this case has a connection to the evaluation unit and/or information unit. The regulating unit influences the operating behavior of the water lance blower according to stored procedures which are dependent on the incoming data of the evaluation unit or on the instructions of an operator. Thus, a reduction in the water jet quantity brought about by the soiling of the nozzle can be directly counteracted such as, for example, by adapting the pressure or the blow figure.

In accordance with again another feature of the invention, the evaluation unit and the regulating unit together form a monitoring unit. It is particularly advantageous to integrate the evaluation unit, the regulating unit and the information unit into a monitoring unit. These units are thereby disposed in a highly compact and protected manner. The monitoring unit is constructed, in particular, as a mobile unit which, if appropriate, can be uncoupled in a simple way from the water lance blower and/or which has devices ensuring a remote diagnosis or remote control of the water lance blower.

With the objects of the invention in view, there is also provided a method for operating a water lance blower for cleaning a thermal installation having flames and/or smoke gases flowing therein during operation. The thermal installation has a hatch and wall regions accessible from the hatch. The method comprises providing a water lance having a mouth and having a nozzle for forming a water jet. The water lance is movably located with the mouth at or in the hatch. The water jet is blown through the thermal installation and onto the wall regions during operation of the thermal installation. The water jet is monitored during operation for detecting and evaluating at least one characteristic parameter for quality of the water jet as a measurement value.

Therefore, in the method according to the invention for operating a water lance blower for the cleaning of thermal installations, a monitoring of the water jet takes place during operation, in such a way that at least one parameter characteristic of the quality of the water jet is detected and evaluated as a measurement value. The characteristic parameter in this case is itself a describing quantity for assessing the water jet quality or is related to the operating behavior of the water lance blower and thus makes it possible to indirectly draw conclusions as to the water jet quality. The detection of the measurement values is carried out, during the operation of the water lance blower, at predeterminable time points or continuously. An evaluation of the characteristic measurement values is carried out in such a way that they are compared, for example, with reference values. Information on the quality of the generated water jet and on the degree of soiling of the nozzle is obtained from the comparison of the detected measurement values and stored reference values.

In accordance with another mode of the invention, at least one sensor on the water lance detects at least one characteristic parameter. Depending on the type of the characteristic parameter, the at least one sensor is directly in contact with the water jet or, for example, measures flow parameters of the water stream or is disposed on or in the nozzle and thus detects, for example, temperatures or vibrations of the water lance.

In accordance with a further mode of the invention, the water jet being generated can be characterized through the use of a number of describing parameters. Such describing parameters are, for example, the jet opening angle, the velocity of the emerging water, the water throughput through the nozzle or a pressure generated in the water lance. The jet opening angle describes the widening of the generated water jet after it leaves the nozzle. The velocity relates to the kinetic jet energy and characterizes the velocity of the water drops at which they emerge from the nozzle of the water lance. The water throughput describes the water quantity which flows through a cross section of the nozzle within a defined time. The pressure in the nozzle is generated by at least one pump and is also dependent, for example, on the leak-tightness of the water line, the wall friction in the water delivery lines or the water outlet cross section of the nozzle.

In accordance with an added mode of the invention, the jet opening angle is detected as a characteristic measurement value. This is carried out, in particular, through the use of sensors which are disposed on or in the water lance in surroundings which are near the water jet, and which measure the water fraction in the surrounding air. Jet formation is adversely influenced by dirt which has settled in the nozzle outlet. This may lead, for example, to breakaway effects or to the bursting open of the water jet. The water jet therefore becomes highly diffuse. The sensors are individually insulated and preferably disposed directly at the nozzle outlet to measure capacitively. The sensors have a capacitance which depends substantially on the distance and the material between the capacitor plates. In this case, the material between them is air with a determinable water fraction, the latter resulting in a defined dielectric constant of the air/water mixture.

In accordance with an additional mode of the invention, the dielectric constant varies as a result of a changed water fraction in the air, which influences the capacitance of the sensors and thus makes it possible to directly evaluate the water jet quality. If the jet opening angle is very large, the capacitor plates may even be electrically conductively connected through the use of the water.

In the event of heavy nozzle soiling, the nozzle outlet area decreases and the wall friction rises. The water throughput quantity falls, while at the same time there is a slight increase in the water velocity. This can be detected, for example, through the use of changed pressures of the water jet within the nozzle. Therefore, in accordance with yet another mode of the invention, the pressure and/or a time profile of the pressure of the water before it emerges from the nozzle is measured as a characteristic parameter. Advantageously, sensors are constructed, for example, as compact pressure switches or electrical pressure transducers, since they supply highly reliable measurement values.

In accordance with yet a further mode of the invention, the velocity and/or a time profile of the velocity of the emerging water jet is measured. It is particularly advantageous to derive the velocity from the water throughput, that is to say from the water quantity per unit time through a nozzle cross section. In particular, it is advantageous to use an inductive flowmeter, in which the measured voltage is proportional to the flow velocity of the water stream. A simple construction or flexible configuration of such a measuring device on the water lance is thus ensured.

In accordance with yet an added mode of the invention, in order to provide a more accurate evaluation of the nozzle soiling, a sensor for detecting the water pressure and a further sensor for measuring the water throughput are used in order to determine the water jet quality. The water pressure is usually subject to fluctuations which arise, for example, due to impurities in the delivery lines or in the preceding pump. The influence of such fluctuations in an evaluation of the detected measurement values with regard to nozzle soiling is avoided as a result of an additional measurement of the water throughput. The analysis of both measurement values makes it possible to have reliable evidence of nozzle soiling and therefore of water jet quality.

The water jet being generated influences the operating behavior of the water lance blower. Thus, for example, pulsating pressure fluctuations result in an increased vibration of the water lance. A variation in the water jet quality can consequently also be derived from a changed operating behavior of the water lance blower. The operating behavior of a water lance blower can be described, for example, in terms of body vibrations or temperatures of the water lance. Therefore, in accordance with yet an additional mode of the invention, at least one characteristic measurement value is derived from the operating behavior of the water lance blower.

In accordance with again another mode of the invention, the body vibrations of the water lance are measured and a characteristic measurement value for the water jet quality is derived therefrom. Solid-borne sound sensors are particularly suitable for measuring the body vibrations. The detection of measurement values in this case takes place preferably at a region of the water lance which is disposed outside the thermal installation. Detected frequency bands are displaced according to the degree of soiling of the nozzle and, in particular, a displacement toward higher frequencies is to be noted in the case of a dirty nozzle.

In accordance with again a further and very particularly preferred mode of the invention, a temperature/time profile is detected at least at one measurement point on the water lance. The measurement points are disposed in a region of the water lance which is located very near the thermal installation. The temperature/time profile is detected through the use of at least one sensor, the latter being disposed preferably on a surface and/or in a depression of the nozzle. This is understood to mean, in particular, that a sensor is disposed either on the surface or in a depression (for example a bore) in the material of the nozzle. In addition, it is possible to position the sensor in a depression produced as a groove, in which case the sensor may extend both into the groove and over regions on the surface. This advantageous configuration of the sensor in a groove ensures the contact of the sensor with the external surroundings of the water lance and at the same time protects the sensor against surrounding influences such as, for example, soiling or the external action of force.

In accordance with again an added mode of the invention, the detection of the temperature/time profile of the nozzle wall, particularly at the start of cleaning and/or at the end of cleaning, which corresponds to the cooling or heating behavior, makes it possible to assess the degree of soiling of the nozzle. A dirt layer between the water jet and the nozzle impedes the transmission of heat. Furthermore, the wall friction is increased and the velocity is reduced due to a dirt layer inside the nozzle, with the result that the temperature/time profile in the nozzle is likewise influenced.

In accordance with again an additional mode of the invention, the temperature profile in or directly on the nozzle wall is detected through the use of one sensor and additionally the actual water temperature upon entry into the water lance is detected through the use of a further sensor. The water lance blower is operated in predeterminable cycles and is in a defined position of rest after such a cycle. At the very start of such a cycle, that is to say during a detection of measurement values, the water in the delivery lines for the water lance blower initially has an increased temperature because it is in the immediate vicinity of the thermal installation. This temperature falls as operation proceeds. There is therefore no constant water temperature which could be used as a reference quantity for the temperature profile in the nozzle wall. For this reason, the temperature profiles of the water and the nozzle are detected in parallel. In order to provide a subsequent evaluation of the measurement values, in particular, the ratio of the time change (gradient) of the temperature profile in the nozzle and an instantaneous temperature difference between the nozzle and the water is determined and makes it possible to have reliable evidence of nozzle soiling. In this connection, the instantaneous temperature difference describes a driving force which causes the variation in the nozzle temperature.

In accordance with still another mode of the invention, the at least one characteristic measurement value is transmitted to an evaluation unit. The evaluation unit is preferably preceded by a converter which converts the analog measurement value into digital data. The evaluation unit has the task of comparing the characteristic measurement value with one or more stored measurement values. The transmission of the data preferably takes place through the use of serial interfaces and a databus, in particular through the use of a CAN bus.

In accordance with still a further mode of the invention, the evaluation unit compares the measured characteristic parameter with a predeterminable and stored desired value. The predeterminable desired value describes a water jet of suitable quality. The desired value may be further determined, in particular, with reference to an additional and predeterminable limit value and/or to a predeterminable tolerance range. The limit value or the tolerance range characterizes a water jet, the quality of which is still just sufficient. If the predetermined limit value or tolerance range is overshot or undershot, data and/or pulses are transmitted from the evaluation unit to an information unit.

In accordance with still an added mode of the invention, the evaluation unit records a time profile of measurement values and compares it with at least one reference profile of measurement values and, from the result of this comparison, transmits corresponding data and/or pulses to an information unit. The reference profile may be recorded and stored, for example, when an unsoiled nozzle is in use (calibration). A deviation of the measurement value profile from the reference profile consequently points, for example, to a dirty nozzle. The comparison may advantageously also follow a filtering of the measurement values, in order to eliminate disturbance variables prior to the evaluation of the measurement values.

In accordance with still an additional mode of the invention, a plurality of measurement values and/or different measurement values are transmitted to the evaluation unit and the evaluation unit determines from the measurement values a concise characteristic number for the water jet quality. That characteristic number is subsequently transmitted to the information unit. Due to the fact that the characteristic parameters for describing the quality of the generated water jet interact with one another, it is advantageous to compress a plurality of measurement values into one concise measurement number.

In accordance with another mode of the invention, the data and/or information and/or characteristic numbers are transmitted from the evaluation unit to a regulating unit which influences the operating behavior of the water lance blower. This has the result, for example, that a correction of the blow figure is carried out, the pressure or the throughput of the water stream is changed or, if appropriate, the cleaning process is interrupted. The corresponding procedures whereby the regulating unit reacts to a specific measurement value or measurement value profile are, in particular, stored and can be retrieved at any time from the regulating unit.

In accordance with a further mode of the invention, the information unit optically indicates the received data and/or information and/or characteristic numbers of the quality of the water jet. In particular, an indicator constructed with different colors is suitable for this purpose. A deteriorating quality of the water jet can thus be signaled particularly advantageously through the use of different LED indicators. Thus, a green LED is an indicator pointing to a good quality of the water jet, a yellow LED is an indicator pointing to nozzle soiling and a red LED is an indicator signaling the immediately necessary cleaning or exchange of the nozzle.

In accordance with a concomitant mode of the invention, an acoustic warning signal is emitted when the quality of the water jet is no longer sufficient.

Other features which are considered as characteristic for the invention are set forth in the appended claims.

Although the invention is illustrated and described herein as embodied in a water lance blower with a monitoring device for the quality of a water jet and a method for operating the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
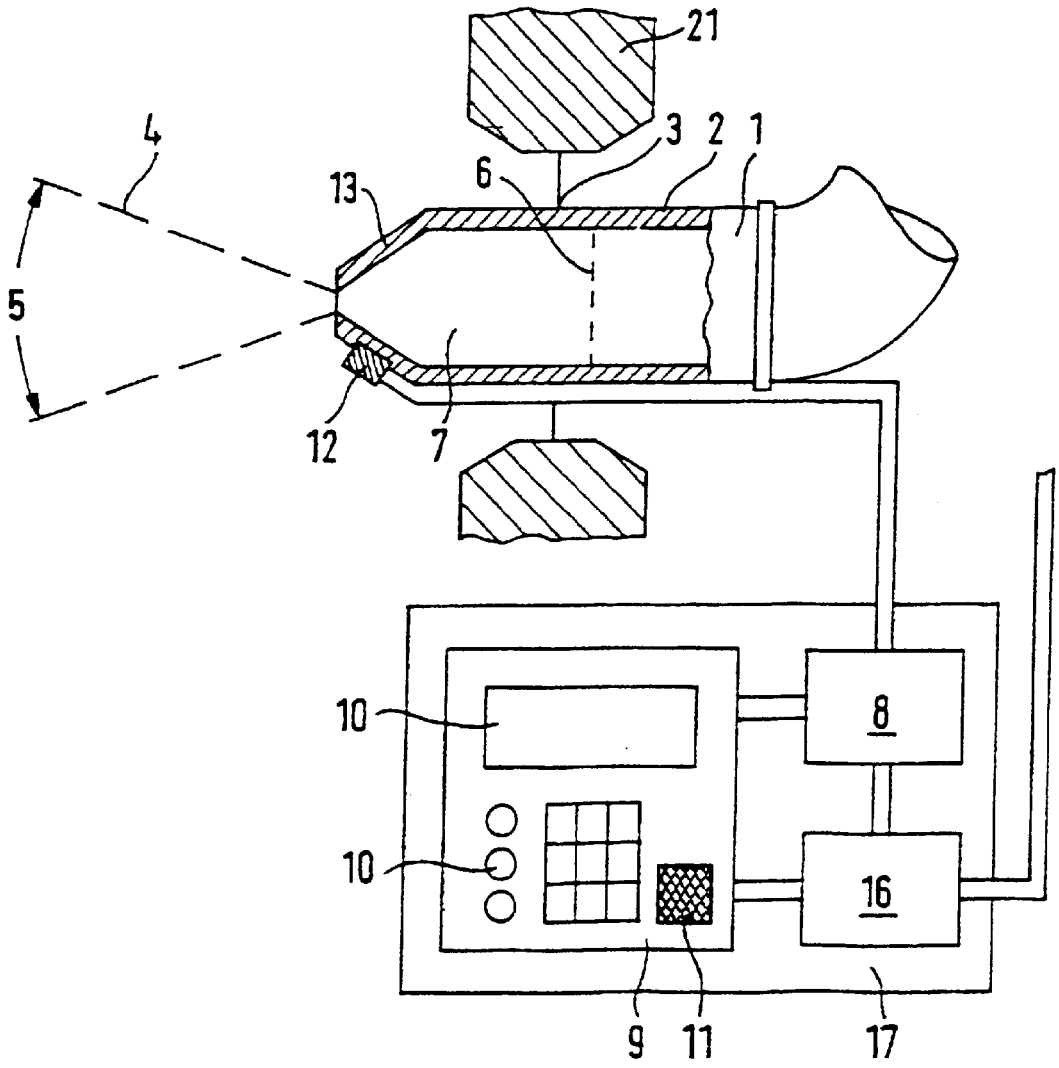
FIG. 1 is a fragmentary, diagrammatic, partly broken-away and partly sectional view of an embodiment of a water lance blower as well as a block diagram of a monitoring device.

Referring now to the figures of the drawings in detail and first, particularly, to FIG. 1 thereof, there is seen a water lance 1 of a water lance blower or blaster for the cleaning of thermal installations. The water lance 1 has a mouth 2, is movably disposed with the mouth 2 at or in a hatch 3 and is capable of blowing a water jet 4 onto wall regions of a thermal installation 21 which are capable of being reached from the hatch 3. The water jet 4 can be described through the use of a jet opening angle 5, a throughput 6 through a cross section (illustrated by a broken line) and a pressure 7 in the water lance 1. The illustrated embodiment includes a sensor 12 which is disposed on a nozzle 13, near the jet outlet. This sensor 12 detects at least one parameter characteristic of the quality of the water jet 4, as a measurement value, and transmits the latter to an evaluation unit 8. Measurement value transmission takes place from the evaluation unit 8 to an information unit 9 or to a regulating unit 16. The information unit 9 has different indicators 10 as well as a loudspeaker 11 for emitting an acoustic signal. Data and/or pulses are transmitted from the information unit 9 to the regulating unit 16. The evaluation unit 8, the information unit 9 and the regulating unit 16 are integrated in an overriding monitoring unit 17.

Figure 2:
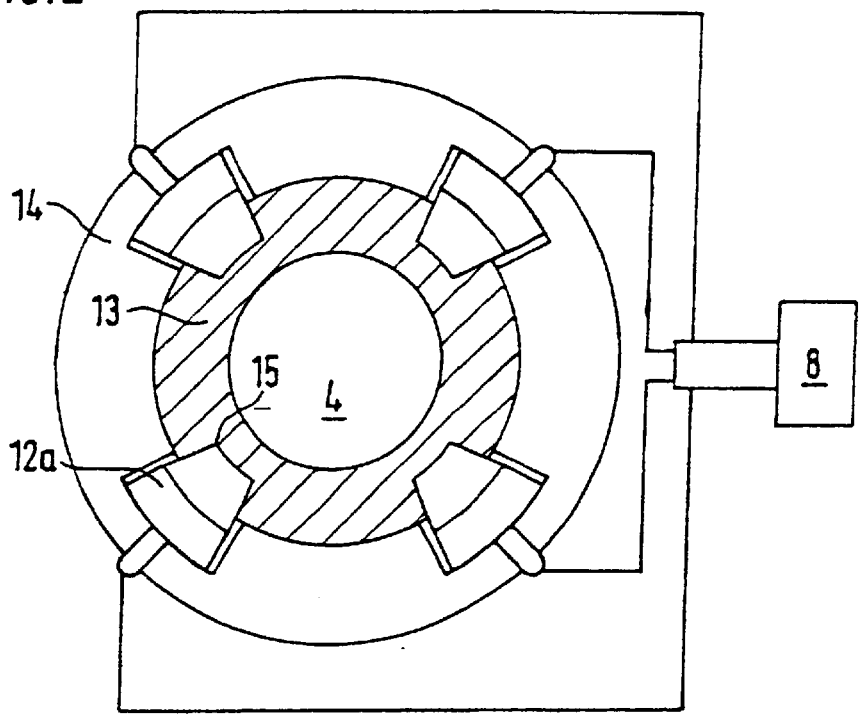
FIG. 2 is an enlarged, end-face cross-sectional view of a nozzle with sensors.

FIG. 2 is a cross-sectional view of an embodiment of a nozzle 13 with capacitively acting sensors 12*a*. In this case, the sensors 12*a* are disposed in depressions 15 which, starting from a surface 14, are shaped into the material of the nozzle 13. The capacitively acting sensors 12*a* are particularly suitable for assessing the jet opening angle 5 in that a water fraction in the immediate surroundings of the nozzle 13 is detected. For this purpose, the sensors 12*a* are disposed so as to be insulated from one another. In the event of a widening of the water jet 4, there is an increased accumulation of water drops or water mist near the sensors 12*a*. In that case, first, a variation in capacitance is to be detected, which ultimately results in a current flow between the sensors 12*a*. These measurement values (for example, electrical voltage, capacitance, current, resistance) are transmitted to the evaluation unit 8.

Figure 3:
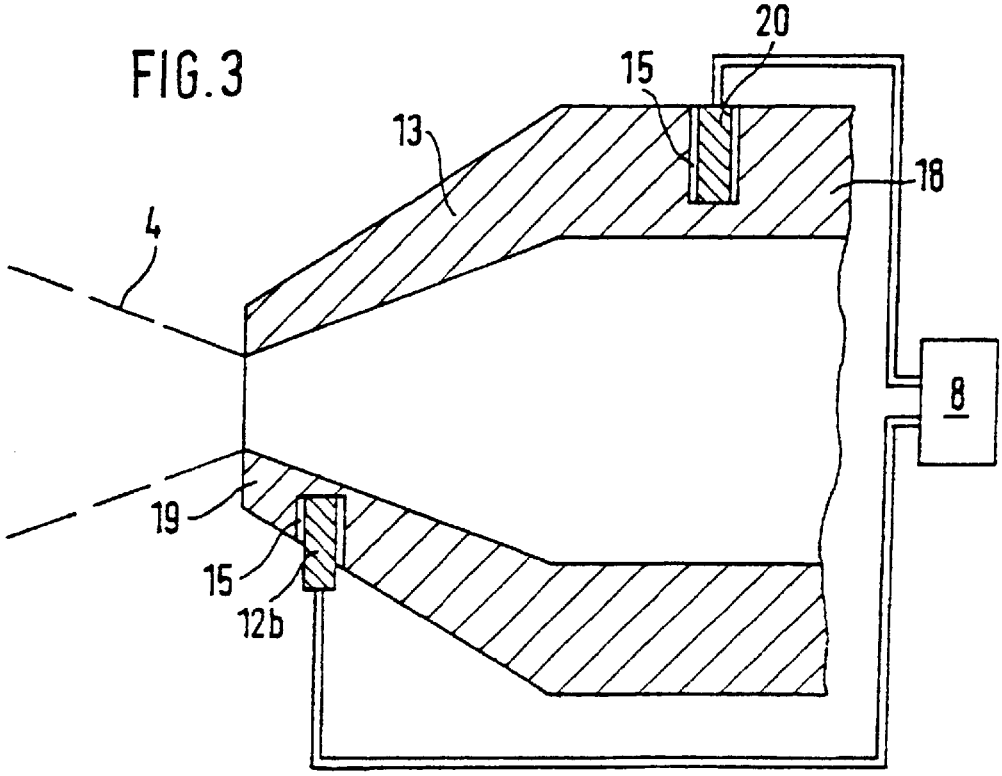
FIG. 3 is a further enlarged, longitudinal-sectional view of a nozzle with thermal sensors according to an exemplary embodiment.

FIG. 3 shows a configuration of a temperature sensor 12*b* for detecting a temperature/time profile of the nozzle and of a measuring device 20 which is suitable for determining water temperature. The sensor 12*b* and the measuring device 20 are each disposed in a depression 15 of the nozzle 13. The measuring device 20 is disposed in a portion 18 of the nozzle 13 which is particularly massive or solid. The sensor 12*b* detects the temperature of the nozzle 13 and is located in a region 19 of smaller wall thickness, near the water jet 4, and thus detects the water temperature with only a slight deviation. When the water jet 4 is switched on, a cooling of the nozzle 13 takes place from the inside outward. The thermal conduction in the material of the nozzle 13 is dependent substantially on the thermal conductivity of the nozzle material and on the transmission of heat from the water stream 4 to the nozzle 13. Particles which have settled on the nozzle 13 and which are formed, for example, of ash, soot, scale or lime, impede the transmission of heat and correspondingly influence the cooling behavior of the nozzle 13. The continuously detected temperature measurement values are transmitted to the evaluation unit 8. The latter calculates a characteristic number which is characteristic of the water jet quality from the incoming measurement value profile, at defined time intervals. This characteristic number is, in particular, the ratio of the time change of the nozzle temperature during the time interval and the instantaneous temperature difference between the water and the nozzle. The lines leading to the evaluation unit 8 must be protected in a special way, since the sensors 12*b* are exposed to high temperatures and to heavy soiling.

We claim:

1. A water lance blower for cleaning a thermal installation having flames and/or smoke gases flowing therein during operation, the thermal installation having a hatch and wall regions accessible from the hatch, the water lance blower comprising:

a water lance having a mouth and having a nozzle for forming a water jet;

said water lance being movably disposed with said mouth at or in the hatch for blowing the water jet through the thermal installation and onto the wall regions during operation of the thermal installation; and said water lance having at least one sensor for detecting at least one characteristic parameter, as a measurement value, for monitoring quality of the water jet.

2. The water lance blower according to claim 1, wherein said at least one sensor is a solid-borne sound sensor.

3. The water lance blower according to claim 1, wherein said at least one sensor includes a capacitive sensor for determining a water content in surroundings of said mouth outside the water jet.

4. The water lance blower according to claim 1, wherein said at least one sensor includes a pressure switch for determining a pressure of water in said nozzle.

5. The water lance blower according to claim 1, wherein said at least one sensor includes an electrical pressure transducer for determining a pressure of water in said nozzle.

6. The water lance blower according to claim 1, wherein said at least one sensor includes an inductive sensor for determining a water throughput through said water lance.

7. The water lance blower according to claim 1, wherein said at least one sensor includes at least one temperature sensor disposed on a surface of said nozzle.

8. The water lance blower according to claim 1, wherein said at least one sensor includes at least one temperature sensor disposed in a depression formed in said nozzle.

9. The water lance blower according to claim 1, wherein said at least one sensor includes at least one temperature sensor disposed on a surface of said nozzle and at least one temperature sensor disposed in a depression formed in said nozzle.

10. The water lance blower according to claim 7, which further comprises at least one measuring device for determining water temperature.

11. The water lance blower according to claim 8, which further comprises at least one measuring device for determining water temperature.

12. The water lance blower according to claim 9, which further comprises at least one measuring device for determining water temperature.

13. The water lance blower according to claim 1, which further comprises an evaluation unit connected to said water lance blower for further processing detected measurement values of the characteristic parameter.

14. The water lance blower according to claim 13, wherein said evaluation unit stores at least one reference profile of the measurement values of the characteristic parameter, and said at least one reference profile characterizes a specific quality of the water jet.

15. The water lance blower according to claim 1, which further comprises an information unit connected to said water lance blower.

16. The water lance blower according to claim 1, which further comprises a regulating unit connected to said water lance blower, for influencing an operating behavior of said water lance blower.

17. A method for operating a water lance blower for cleaning a thermal installation having flames and/or smoke gases flowing therein during operation, the thermal installation having a hatch and wall regions accessible from the hatch, the method which comprises:

providing a water lance having a mouth and having a nozzle for forming a water jet;

movably locating the water lance with the mouth at or in the hatch;

blowing the water jet through the thermal installation and onto the wall regions during operation of the thermal installation; and monitoring the water jet with at least one sensor of the water lance during operation for detecting and evaluating at least one characteristic parameter for quality of the water jet as a measurement value.

18. The method according to claim 17, which further comprises measuring at least one of a pressure and a time profile of the pressure of water in the water lance, upstream of the nozzle, as the at least one characteristic parameter.

19. The method according to claim 17, which further comprises measuring at least one of a throughput and a time profile of the throughput of water in the water lance, as the at least one characteristic parameter.

20. The method according to claim 17, which further comprises detecting a jet opening angle of the water jet, as the at least one characteristic parameter.

21. The method according to claim 20, which further comprises carrying out the step of detecting the jet opening angle with at least one sensor disposed in vicinity of the water jet for measuring a water fraction in surrounding air.

22. The method according to claim 17, which further comprises measuring body vibrations of the water lance generated at least by the water jet to provide measurement values, and subsequently deriving the at least one characteristic parameter of quality of the water jet from the measurement values.

23. The method according to claim 17, which further comprises detecting a temperature/time profile at least at one measurement point on the water lance as the at least one characteristic parameter, with at least one sensor.

24. The method according to claim 23, wherein the at least one measurement point is at least one of a start and an end of cleaning.

25. The method according to claim 23, which further comprises measuring water temperature with a measuring device and using the water temperature to adapt or correct the at least one characteristic parameter.

26. The method according to claim 17, which further comprises transmitting the measurement value of the at least one characteristic parameter to an evaluation unit.

27. The method according to claim 26, which further comprises storing at least one reference profile of measurement values of the at least one characteristic parameter in the evaluation unit, and the evaluation unit recording a profile of measurement values of the at least one characteristic parameter over a period of time and comparing it with the at least one reference profile, receiving a result of the comparison and subsequently transmitting at least one of data and pulses to an information unit.

28. The method according to claim 27, which further comprises conducting a plurality of characteristic parameters to the evaluation unit, and the evaluation unit determining a characteristic number of the water jet quality from the plurality of characteristic parameters and transmitting the characteristic number to the information unit.

29. The method according to claim 28, which further comprises transmitting at least one of the data, information and characteristic number from the evaluation unit to a regulating unit influencing an operating behavior of the water lance blower.

* * * * *